US006286488B1

(12) United States Patent
Wisinski

(10) Patent No.: US 6,286,488 B1
(45) Date of Patent: Sep. 11, 2001

(54) DIESEL ENGINE START ASSIST APPARATUS

(75) Inventor: Jeffrey D. Wisinski, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/414,464

(22) Filed: Oct. 7, 1999

(51) Int. Cl.[7] ..... F02D 41/38; F02N 17/08
(52) U.S. Cl. ..... 123/481; 123/179.16
(58) Field of Search ..... 123/179.16, 179.17, 123/481, 198 F

(56) References Cited

U.S. PATENT DOCUMENTS 5,117,790 * 6/1992 Clarke et al. ..... 123/198 F
5,813,383 * 9/1998 Cummings ..... 123/198 F
5,890,467 * 4/1999 Romzek ..... 123/481

* cited by examiner

*Primary Examiner*—Andrew M. Dolinar
(74) *Attorney, Agent, or Firm*—Carl A. Rowold, Esq.; David G. Maire, Esq.; Beusse, Brownlee, Bowdoin & Wolter, P.A.

(57) ABSTRACT

A start assist device for an engine having a means for supplying fuel to fewer than all of the cylinders of the engine at engine cranking speeds that are less than the speed wherein the fuel injection system provides fuel to all of the cylinders. In one embodiment for a diesel locomotive engine, fuel is supplied to two cylinders beginning at 45 RPM to assist the engine starter in achieving an engine cranking speed of 90 RPM wherein the fuel injection system begins to provide fuel to all of the cylinders.

12 Claims, 2 Drawing Sheets

DIESEL ENGINE START ASSIST APPARATUS

BACKGROUND OF THE INVENTION

This invention relates generally to the field of diesel engines, and more particularly to an apparatus for starting a large diesel engine in a railroad locomotive.

Modern locomotive engines are generally powered by a large diesel engine. For example, the assignee of the present invention provides diesel locomotives having a sixteen cylinder diesel engine, producing a peak power output in the range of 4,500 horsepower.

The initial starting of a cold diesel engine can be a difficult task, especially when the engine is large and is exposed to reduced ambient temperatures. Railroad locomotives incorporate large battery systems to provide power for an electric starter motor used to initiate the rotation of the diesel engine. Because diesel combustion depends upon the compression of the fuel within the cylinders of the engine to produce the necessary heat for combustion of the fuel, it is known to begin the supply of fuel to a large diesel engine only after the starter motor has raised the speed of the diesel engine to above a predetermined value. For example, many of the diesel locomotives supplied by the assignee of the present invention are equipped with a Bryce® fuel injection system provided by Lucas Industries Public Limited of the United Kingdom. The Bryce fuel injection system is designed to begin supplying fuel to the diesel engine only after the cranking speed of the engine has exceeded 90 revolutions per minute (RPM). While this design works well in most applications, there are occasions when it is extremely difficult to spin the diesel engine to 90 RPM with the starter motor. Such difficulties have been known to occur in very cold weather conditions and when one or more of the starter batteries is in a conditions and when one or more of the starter batteries is in a weakened condition. Should the starter motor be unable to achieve a cranking speed of 90 RPM in the diesel engine, the engine will not start because no fuel will be provided by the fuel injection system. The Bryce fuel injection system currently installed on many of the locomotive engines supplied by the assignee of this invention is not designed to permit the setpoint of 90 RPM to be changed. Therefore, there is little that the locomotive operator can do to start the diesel engine in the event that the starter motor fails to achieve the required engine cranking speed.

BRIEF SUMMARY OF THE INVENTION

Thus there is a particular need for an apparatus to assist in the starting of a diesel engine of a railroad locomotive. A diesel engine start assist device is provided having a controller; circuitry in the controller operable to engage a means for providing fuel to fewer than all of the cylinders of the diesel engine; a first input to the controller for receiving a fuel injection signal from a fuel injection system for the diesel engine indicating when fuel is being supplied to all of the cylinders of the diesel engine by the fuel injection system; and circuitry within the controller responsive to the fuel injection signal and operable to disengage the means for providing fuel to fewer than all of the cylinders when fuel is being supplied to all of the cylinders by the fuel injection system.

DETAILED DESCRIPTION OF THE INVENTION

Figure 1:
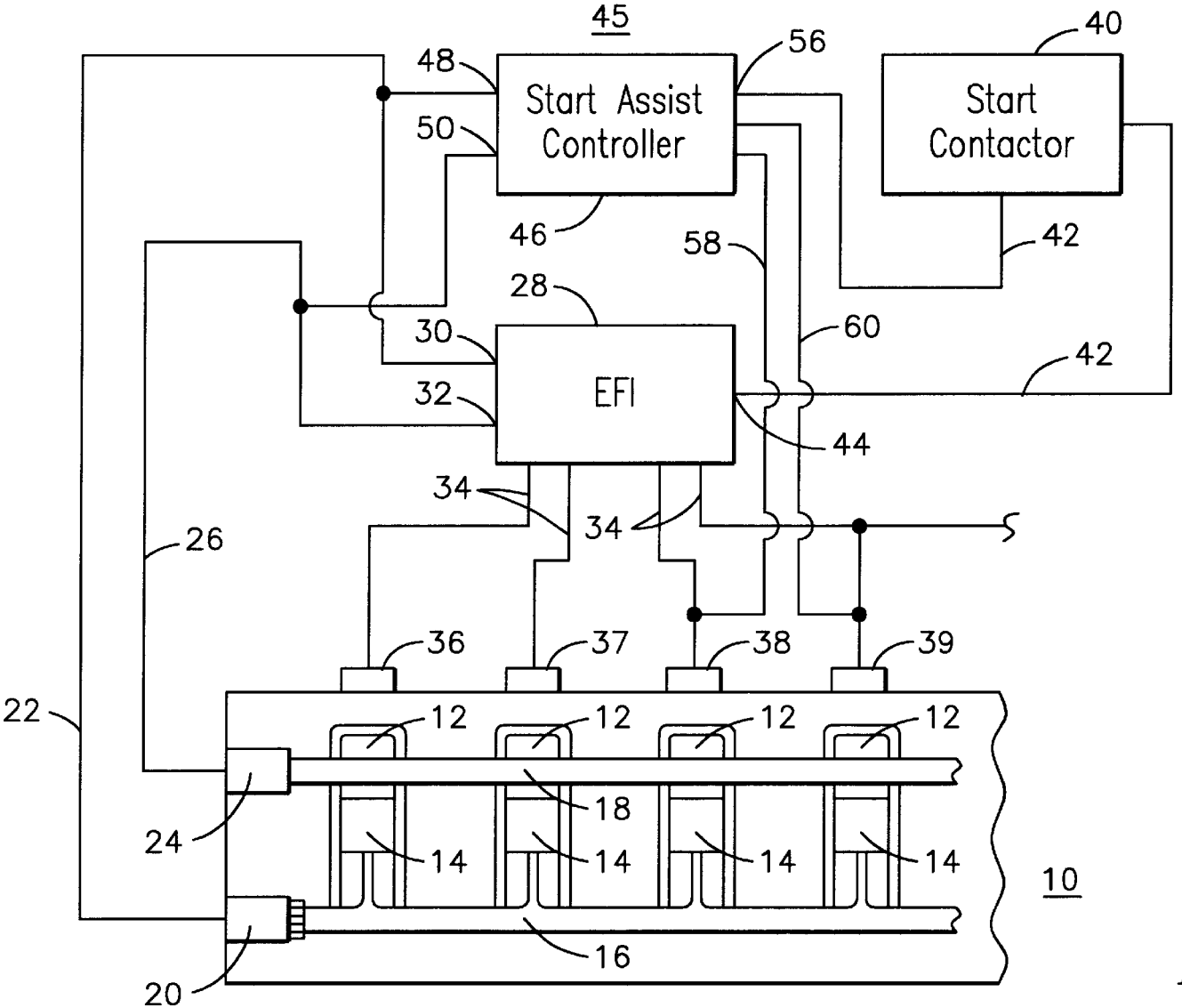
FIG. 1 is a schematic illustration of a diesel engine having an electronic fuel injection system and an engine start assist device.

FIG. 1 illustrates a schematic representation of a diesel engine 10 having a plurality of cylinders 12, with each cylinder 12 containing a piston 14 connected to a crank shaft 16. FIG. 1 illustrates four such cylinders 12, although it will be appreciated that a modern railroad locomotive may typically include a sixteen cylinder engine. A cam shaft 18 works cooperatively with crank shaft 16 to open and close valves for each cylinder 12 at appropriate times during the rotation of the crank shaft 16. A crank shaft position sensor 20 provides a crank shaft signal 22 corresponding to the position/speed of the crank shaft 16. Similarly, a cam shaft position sensor 24 provides a cam shaft signal 26 corresponding to the position/speed of the cam shaft 18.

An electronic fuel injection system 28 has a crank shaft signal input 30 for receiving the crank shaft signal 22 and a cam shaft signal input 32 for receiving the cam shaft signal 26. The fuel injection system 28 contains circuitry for generating a plurality of fuel injection output signals 34 for controlling a fuel injection device 36,37,38,39 associated with each of the respective cylinders 12. Fuel injection devices 36–39 may be any of the mechanisms known in the art for selectively controlling the flow of fuel to the respective cylinders 12. For example, fuel injection devices 36–39 may be solenoid valves that control the flow of fuel from one or more fuel pumps, or they may be a combination of valves and pumps that operate to supply fuel to the cylinders 12 at selected intervals and in selected amounts. When it is activated, fuel injection system 28 provides fuel selectively to all of the cylinders 12 based upon the position of the piston in its firing sequence and based upon the demand of the throttle mechanism (not shown).

In response to the operator or computerized locomotive controller command 42 to start the diesel engine 10, the start contactor is energized and the fuel injection system 28 is enabled. The electronic fuel injection system 28 has a starter signal input 44 for receiving the engine start signal 42. The electronic fuel injection system 28 may be designed to initiate the flow of fuel to all of the cylinders 12 only when the speed of rotation of the engine 10 is above a predetermined value, as determined by reference to one or both of the crank shaft signal 22 and cam shaft signal 26. For many of the modern, sixteen cylinder diesel locomotive engines provided by the assignee of the present invention and equipped with a Bryce electronic fuel injection system, this predetermined value is ninety RPM, as discussed above.

A start assist device 45 is provided having a controller 46. Controller 46 has a crank shaft signal input 48 for receiving the crank shaft signal 22 and a cam shaft signal input 50 for receiving the cam shaft signal 26. The start assist device controller 46 also has a starter signal input 56 for receiving engine start signal 42.

Circuitry within the controller 46 is operable to engage fuel injection devices 38,39 via start assist signals 58,60 to provide fuel to fewer than all of the cylinders 12 of the diesel engine 10 during the engine starting process prior to the time when the fuel injection system 28 provides fuel to all of the cylinders 12. When the operator or locomotive computerized controller initiates an engine start sequence, engine starting contactor 40 provides an engine start signal 42 to the start assist device controller 46. Controller 46 is programmed with a set point for engine cranking speed of rotation that is preferably less than the equivalent set point of the fuel injection system 28 for providing fuel to all of the cylinders 12. The engine cranking speed of rotation is determined by both the fuel injection system 28 and the engine start assist controller 46 by reference to one or both of the crank shaft signal 22 and cam shaft signal 26. Circuitry in controller 46 is responsive to at least one of the crank shaft and cam shaft signals (22,26) and is operable to produce an engine speed signal corresponding to the engine speed of rotation. Prior to the engine speed achieving the fuel injection system engine speed set point value, the cranking speed of the engine 10 will exceed the set point value of the start assist device controller 46. In one embodiment the set point value of the start assist device controller 46 is forty five RPM. Once this set point is exceeded, circuitry in the controller 46 responsive to the engine speed signal engages fuel injection devices 38,39 via start assist signals 58,60 to selectively provide fuel to only two cylinders of the engine 10. The combustion of this fuel provides energy to assist the starter motor to increase the engine speed, so that there is a higher level of assurance that the engine speed set point of the fuel injection system 28 will be achieved, even in adverse temperature conditions or in the event of a degraded starter battery system. If no such adverse or degraded conditions are present, the action of the start assist device to provide fuel to fewer than all of the cylinders 12 provides an advantage of reduced starter motor and battery wear.

When the engine speed increases to the set point at which the fuel injection system 28 begins to supply fuel to all of the cylinders 12, controller 46 deactivates the supply of fuel to fewer than all of the cylinders 12. Furthermore, when the engine reaches a predetermined higher speed, such as for example two hundred RPM, engine starting contactor 40 may be designed to terminate the starter motor operation and to impede starter signal 42 from reaching start assist controller 46. Circuitry in controller 46 may be designed to recognize this signal modulation to provide a redundant means for terminating the flow of fuel to fewer than all of the signals via the start assist device.

Figure 2:
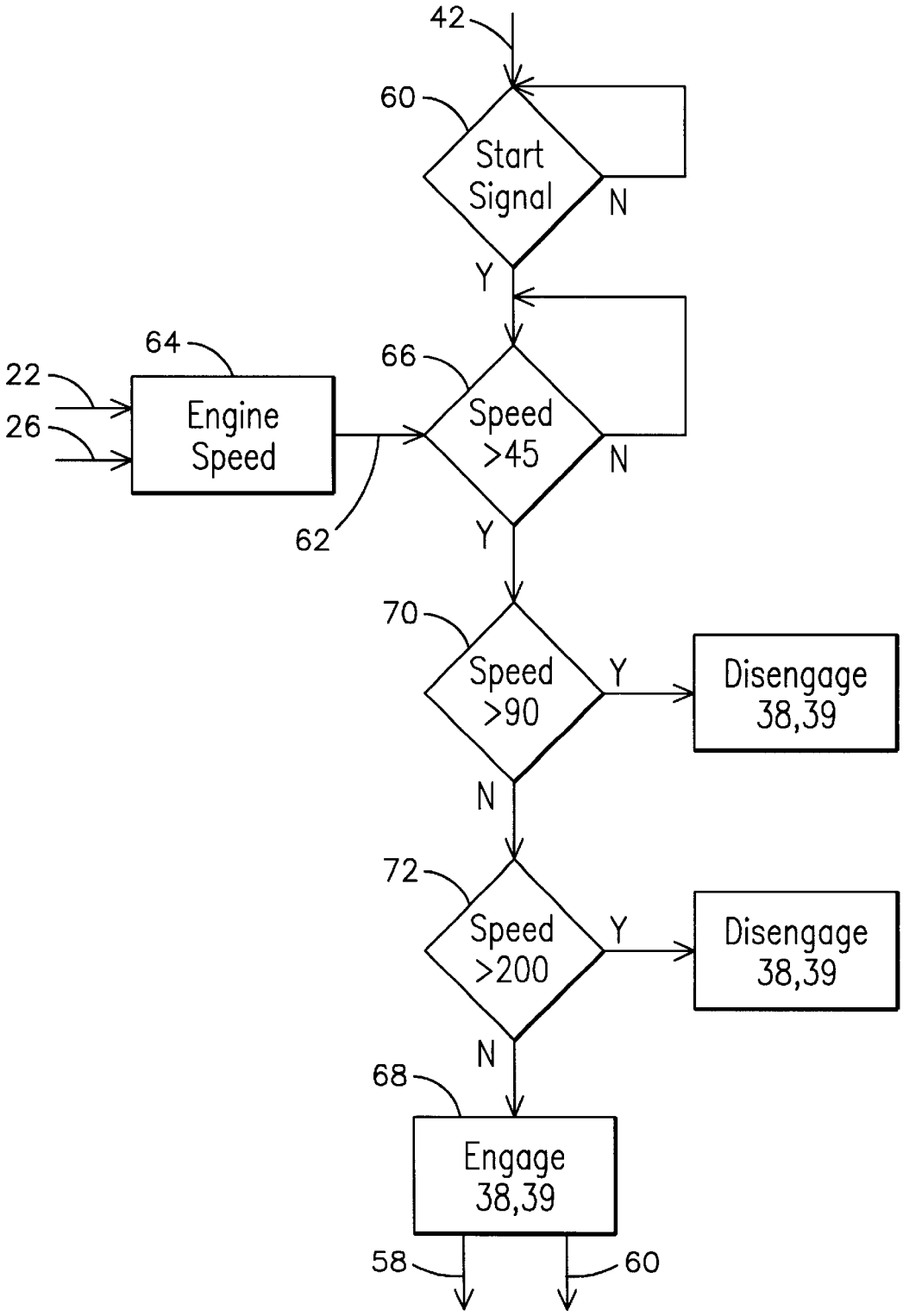
FIG. 2 is a diagram of logic embodied in controller 46 of FIG. 1.

FIG. 2 illustrates the logic that may be embodied in controller 46 of FIG. 1. In step 60, controller 46 determines if engine start signal 42 is present. Crank shaft signal 22 and/or cam shaft signal 26 are utilized by controller 46 to produce an engine speed signal 62 in step 64. The engine speed is compared to a first predetermined value, for example 45 RPM, in step 66. When the engine speed exceeds the predetermined value, the controller 46 functions to engage fuel injection devices 38,39 in step 68. Should the engine speed exceed a second predetermined value where the fuel injection system 28 becomes active, for example 90 RPM, the controller 46 will disengage fuel injection devices 38,39 in step 70. Similarly, if the engine speed exceeds a third predetermined value where the engine starter is disengaged, such as for example 200 RPM, the controller 46 will disengage fuel injection devices 38,39 in step 72.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, the embodiment of the invention illustrated in the Figure provides fuel to two cylinders prior to the activation of the fuel injection system 28, however, it can be appreciated that fuel may be provided to one or more cylinders 12 in other embodiments. Also, the controller 46 may be embodied as hardware, software, or a combination of the two. Therefore, it is intended that the invention not be limited to the particular embodiment disclosed as the best mode contemplated for carrying out this invention, but that the invention will include all embodiments falling within the scope of the appended claims.

What is claimed is:

1. A diesel engine start assist device comprising:

a controller;

a means for providing fuel to fewer than all cylinders of a diesel engine, said means for providing fuel to fewer than all of the cylinders being responsive to the controller;

a first input to the controller for receiving a crank shaft signal associated with the position of a crank shaft of a diesel engine;

a second input to the controller for receiving a cam shaft signal associated with the position of a cam shaft of the diesel engine; and circuitry in the controller responsive to at least one of the crank shaft and cam shaft signals and operable to produce a speed signal corresponding to the speed of rotation of the diesel engine; and circuitry in the controller responsive to the speed signal and operable to engage the means for providing fuel to fewer than all of the cylinders only when the speed of rotation is above a first predetermined value.

2. The diesel engine start assist device of claim 1, wherein the first predetermined value is 45 revolutions per minute.

3. The diesel engine start assist device of claim 1, further comprising a fuel injection system operable to provide fuel to all of the cylinders when the speed of rotation is above a second predetermined value, and wherein the second predetermined value is greater than the first predetermined value.

4. The diesel engine start assist device of claim 3, wherein the second predetermined value is 90 revolutions per minute and the first predetermined value is 45 revolutions per minute.

5. The diesel engine start assist device of claim 1, wherein the means for providing fuel to fewer than all of the cylinders consists of means for providing fuel to two cylinders.

6. A diesel engine comprising:

a plurality of cylinders;

a fuel injection apparatus for selectively supplying fuel to all of the cylinders, wherein the fuel injection apparatus is operable only when the diesel engine is rotating above a full fuel injection speed;

a start assist apparatus for selectively supplying fuel to fewer than all of the cylinders, wherein the start assist apparatus is operable only when the diesel engine is rotating above a start assist fuel injection speed, the start assist fuel injection speed being less than the full fuel injection speed.

7. The diesel engine of claim 6, wherein the plurality of cylinders is sixteen cylinders and wherein the start assist apparatus provides fuel to only two cylinders.

8. The diesel engine of claim 6, further comprising an engine starting contactor operable to provide an engine start signal, and wherein the start assist apparatus is responsive to an engine start signal.

9. The diesel engine of claim 6, further comprising a controller for deactivating the start assist apparatus when the fuel injection apparatus is operable.

10. An engine start assist device for a multiple cylinder, fuel injected, internal combustion engine comprising:

a controller receiving an engine speed signal indicative of engine speed as an input and generating an engine control output signal responsive to the input; and at least one fuel injection device for at least one of the cylinders, being connected to and receiving the engine control output signal from the controller and providing fuel under pressure to and only to fewer than all of the cylinders of an engine in response to the engine control output signal corresponding to an engine speed greater than a first predetermined speed and less than an engine idle speed whereat fuel is injected to all cylinders of the engine.

11. The device of claim 10, further comprising a plurality of fuel injection devices, one for each of all of the cylinders, and the controller enabling fuel to be provided to all cylinders of the engine when the engine speed signal indicates an engine speed above a second predetermined speed greater than the first predetermined speed and less than the engine idle speed.

12. An engine comprising:

a plurality of cylinders;

a fuel injection system including at least one fuel injection device for supplying fuel under pressure to at least one of the cylinders, the fuel injection system operable to supply fuel to all of the plurality of cylinders when the speed of rotation of the engine exceeds a full fuel injection speed;

a sensor associated with the engine and generating an engine speed signal indicative of the speed of rotation of the engine;

a start assist device controlling the fuel injection device for providing fuel to and only to fewer than all of the plurality of cylinders in response to the engine speed signal corresponding to an engine speed above a start assist fuel injection speed and below the full fuel injection speed.

* * * * *